US011104467B2

(12) United States Patent
Burgess

(10) Patent No.: US 11,104,467 B2
(45) Date of Patent: Aug. 31, 2021

(54) HOLE CUTTER FOR THERMOFORMING PACKAGING MACHINE AND METHOD OF USE

(71) Applicant: UltraSource LLC, Kansas City, MO (US)

(72) Inventor: Eric Lee Burgess, Overland Park, KS (US)

(73) Assignee: UltraSource LLC, Kansas City, MO (US)

( * ) Notice: Subject to any disclaimer, the term of this patent is extended or adjusted under 35 U.S.C. 154(b) by 0 days.

(21) Appl. No.: 16/743,336

(22) Filed: Jan. 15, 2020

(65) Prior Publication Data

US 2021/0214112 A1 Jul. 15, 2021

(51) Int. Cl.
*B65B 9/02* (2006.01)
*B65B 61/16* (2006.01)

(52) U.S. Cl.
CPC ..... *B65B 61/16* (2013.01); *B65B 9/02* (2013.01)

(58) Field of Classification Search
CPC ..... B65B 6/00; B65B 61/02; B65B 61/16; B65B 9/02; B65B 67/00; B65B 43/04; B29C 2793/00; B29C 2793/0009; B29C 2793/0018; B29C 2793/009; B26F 2210/00; B26D 1/0006; B26D 1/015; B26D 1/04; B26D 1/045
USPC ..... 53/128, 128.1, 133.1, 134.1, 391; 225/2, 225/91; 83/861, 405, 406, 515, 518
See application file for complete search history.

(56) References Cited

U.S. PATENT DOCUMENTS 4,567,711 A * 2/1986 Hodnett ..... B26F 1/22 53/128.1
4,682,976 A * 7/1987 Martin ..... B31B 70/00 493/194
4,819,406 A * 4/1989 Redmond ..... B65B 57/04 53/51
4,898,280 A * 2/1990 Runge ..... B29C 65/18 383/200
5,014,493 A * 5/1991 West ..... B65B 9/2042 53/128.1
5,036,643 A * 8/1991 Bodolay ..... B65B 9/093 53/128.1
5,281,795 A * 1/1994 Harlan ..... G07C 13/00 235/50 A
5,787,775 A * 8/1998 Stevens ..... B21D 28/12 83/34
6,519,914 B1 * 2/2003 Pesho ..... B65B 9/02 53/134.1
6,918,332 B1 * 7/2005 Andersen ..... B26F 1/04 30/358
7,631,679 B1 * 12/2009 Hui ..... B26D 7/34 156/250
8,256,189 B2 * 9/2012 Montano ..... B29C 65/7451 53/373.7
8,739,503 B2 * 6/2014 Smith ..... B65D 71/46 53/443

(Continued)

*Primary Examiner* — Hemant Desai
*Assistant Examiner* — Jacob A Smith
(74) *Attorney, Agent, or Firm* — Hovey Williams LLP

(57) ABSTRACT

A hole cutter is provided for a thermoforming packaging machine. The hole cutter uses a single actuator to move a row of film-cutting punches between extended and retracted positions for cutting holes and corresponding chads in a marginal film area of a web of thermoformed product packages.

9 Claims, 10 Drawing Sheets

(56) References Cited

U.S. PATENT DOCUMENTS

2005/0276521 A1* 12/2005 Price ..... B65D 33/005 383/10
2007/0295178 A1* 12/2007 Tsuji ..... B26F 1/0092 83/167
2008/0292821 A1* 11/2008 Dayrit ..... B32B 27/34 428/34.9
2009/0056281 A1* 3/2009 Murray ..... B65B 31/042 53/455
2009/0133367 A1* 5/2009 Gregerson ..... B65B 47/02 53/453
2010/0229502 A1* 9/2010 Iwamoto ..... B65B 15/04 53/128.1
2012/0008884 A1* 1/2012 Murray ..... B65D 75/566 383/104
2012/0174719 A1* 7/2012 Kaufman ..... B26F 1/04 83/23
2012/0275729 A1* 11/2012 Liang ..... B29C 65/524 383/72
2013/0139708 A1* 6/2013 Hotta ..... B26D 7/32 101/26
2013/0280361 A1* 10/2013 Jiang ..... B26D 7/2614 425/218
2014/0231493 A1* 8/2014 Andersen ..... B65D 71/08 229/87.05
2015/0052851 A1* 2/2015 Ballestrazzi ..... B65B 9/067 53/410
2015/0128525 A1* 5/2015 Bartoli ..... B29C 51/04 53/410
2015/0191267 A1* 7/2015 Mochizuki ..... B65H 29/005 53/373.2
2015/0298336 A1* 10/2015 Pantonial ..... B26D 5/005 83/13
2016/0023809 A1* 1/2016 Leeker ..... B23K 26/38 383/10
2016/0159507 A1* 6/2016 Izquierdo Ereno ..... B65B 9/04 53/511
2016/0159526 A1* 6/2016 Kessler, Jr. ..... B65D 33/08 53/452
2018/0009173 A1* 1/2018 Reuteler ..... B29C 66/91231

* cited by examiner

HOLE CUTTER FOR THERMOFORMING PACKAGING MACHINE AND METHOD OF USE

BACKGROUND OF THE INVENTION

The present invention relates generally to horizontal form, fill and seal packaging machines or other types of thermoforming packaging machines and, more particularly, to hole cutters used with such machines to punch a hole in the marginal film area of packages after they have been formed, filled and sealed in the machine so that the hole may be used to hang the packages on display rods at the point of sale. The invention also relates to methods of using the hole cutters to punch the holes in the packages.

Many types of packages that are formed, filled and sealed in thermoforming packaging machines such as horizontal form, fill and seal packaging machines are intended to be hung on display rods at the point of sale. A hole is normally simultaneously punched in the top marginal film area of each package in one or more rows of packages before they are separated from each other in the thermoforming packaging machine.

One device that is conventionally used to punch these holes uses a row of individual pneumatic cylinders that are positioned above the web of packages. Each cylinder carries a cylindrically-shaped punch that is threaded onto the end of the cylinder's piston rod. As the piston rod is extended downwardly by pneumatic pressure, it pushes the punch into the marginal film area of the package to cut a hole and a corresponding disc-shaped chad in the marginal film area. A support plate with a center channel is simultaneously pushed against an opposite side of the marginal film area by a larger pneumatic cylinder to support the opposite side of package marginal film area during the cutting operation. Each of the cylindrical punches normally includes a notch that extends along a portion of the circumference of the cylindrical punch. The notch is intended to create an uncut portion along the circumference of the chad that causes the chad to remain attached to the package marginal film area during the cutting operation so they do not accumulate in the thermoforming packaging machine and on the floor under the thermoforming packaging machine.

While the hole punching device described above is able to operate in a generally satisfactory manner, changing the number and positioning of the individual pneumatic cylinders can be a time-consuming process. These changes may occur a number of times during a day as new production runs involve a change in the number or sizes of the packages in each row of the package layout. The use of individual pneumatic cylinders to separately punch a hole and chad in each package in a row of packages is also disadvantageous in that it increases the maintenance costs for the thermoforming packaging machine and it significantly increases the pressurized air consumption and resulting operating costs for the machine. The threaded attachment of the cylindrical punches to the ends of the cylinder piston rods may also be problematic in that they may tend to loosen and turn over time. This rotational turning of the punch can result in misalignment of the uncut portion of the chad or even cause the punch to extend completely through the package marginal film area and result in the chad being completely severed from the package.

A need has thus arisen for an improved hole punching device that can be more readily changed over when rows having different numbers or sizes of packages are run on the thermoforming packaging machine and that can more reliably maintain the desired chad formation.

SUMMARY OF THE INVENTION

In one aspect, the present invention is directed to a hole cutter for cutting holes in a marginal film area of a web of formed, filled and sealed product packages in a thermoforming packaging machine. The hole cutter comprises: a rigid punch holder mounted in a frame for reciprocating movement between extended and retracted positions; a plurality of film-cutting punches mounted in the punch holder and having a cutting end projecting from the punch holder; a platen mounted in opposition to the punch holder and having at least one recess positioned in alignment with the film-cutting punches for receiving at least a portion of the cutting ends of the film-cutting punches when the rigid punch holder is in the extended position; and an actuator coupled with the punch holder and operable to cause the reciprocating movement of the punch holder between the extended and retracted positions.

In another aspect, the present invention is directed to a thermoforming packaging machine having a hole cutter as described above and a web of formed, filled and sealed product packages extending horizontally between the rigid punch holder and the platen.

In a further aspect, the present invention is directed to a method for cutting holes in a marginal film area of a web of formed, filled and sealed product packages in a thermoforming packaging machine using a hole cutter as described above. The method comprises the steps of: advancing a web of formed, filled and sealed product packages in a horizontal direction between the rigid punch holder and the platen in a cycle of stopped and advancing movement; operating the actuator to reciprocate the rigid punch holder to the extended position when the web is stopped and to the retracted position when the web is advancing; and extending a portion of a tapered cutting end of each film-cutting punch through the marginal film area when the rigid punch holder is moved to the extended position to cause each film-cutting punch to cut in the marginal film area to create a hole and a corresponding chad, wherein the chad has an uncut portion along a circumference of the chad that causes the chad to remain attached to the marginal film area when the rigid punch holder is reciprocated to the retracted position.

DETAILED DESCRIPTION

Figure 1:
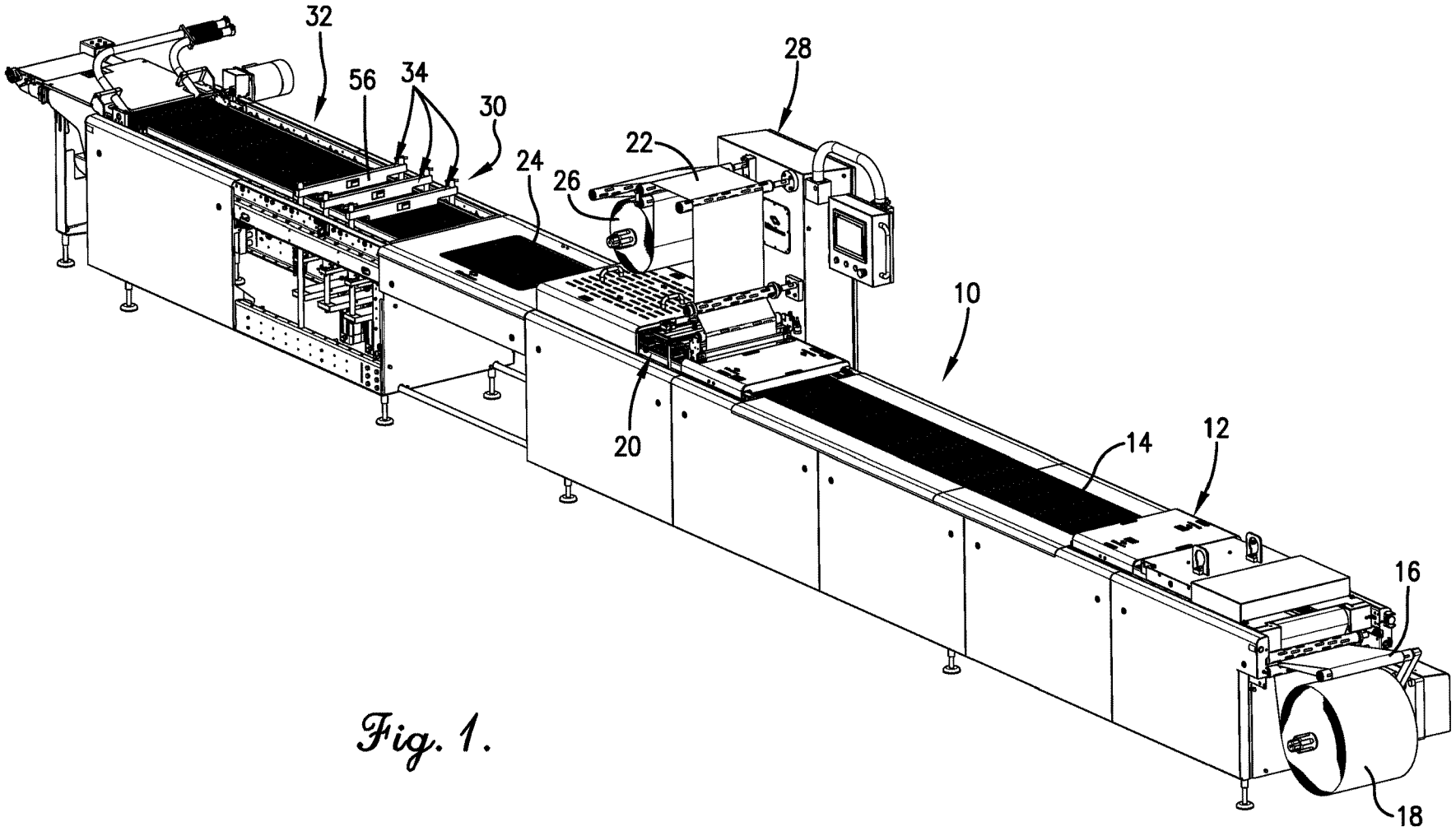
FIG. 1 is a side perspective view of a horizontal form-fill-seal machine having a hole cutter constructed in accordance with one embodiment of the present invention.
Figure 2:
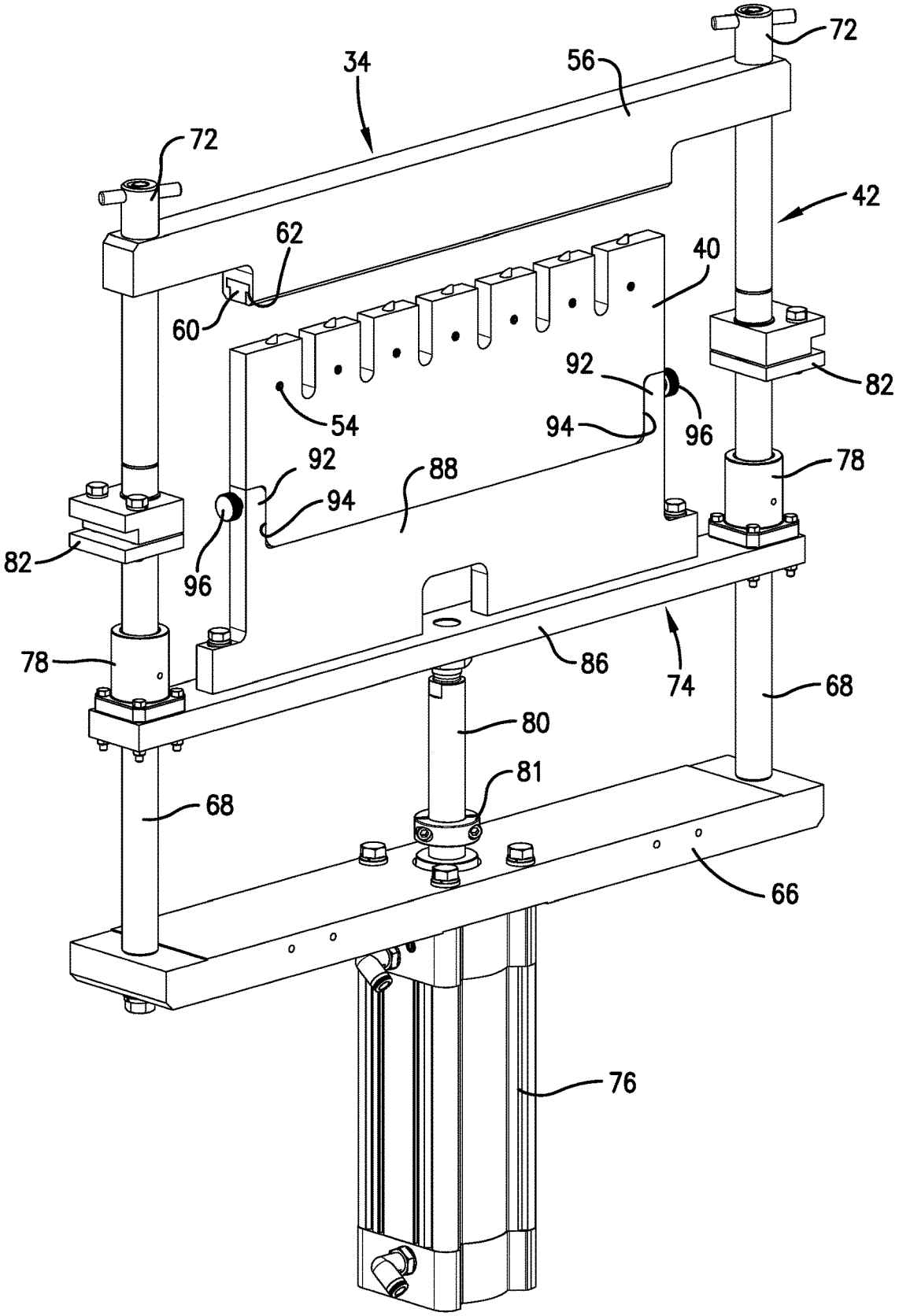
FIG. 2 is a front perspective view of the hole cutter.
Figure 3:
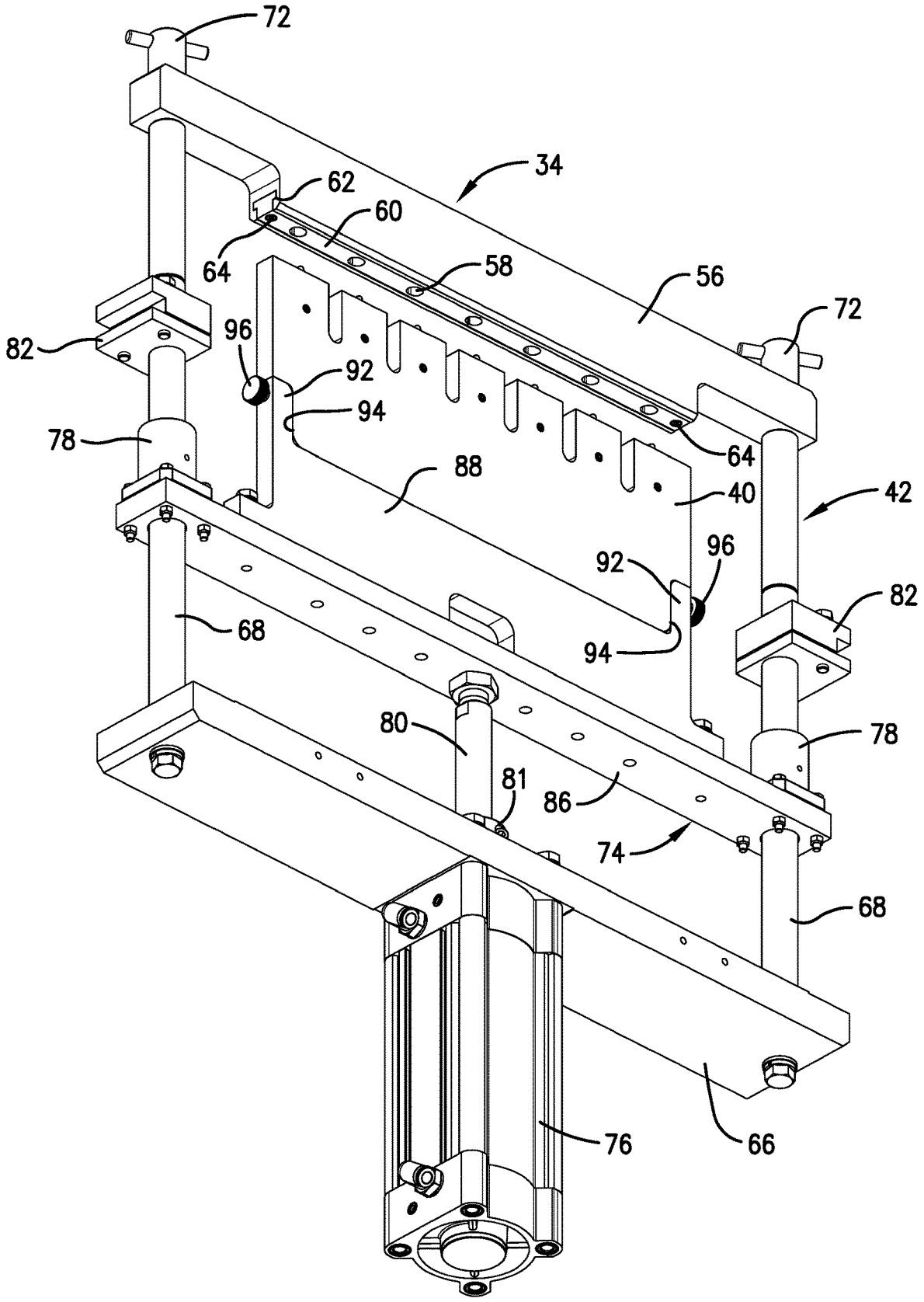
FIG. 3 is a bottom perspective view of the hole cutter.

Turning now to the drawings in greater detail and initially to FIG. 1, a thermoforming packaging machine in the form of a horizontal form, fill and seal machine is designated generally by the numeral 10. The thermoforming packaging machine 10 comprising a package forming station 12 where rows of side-by-side product receptacles 14 are thermoformed in a bottom film 16 dispensed in a step-wise indexing fashion of stopped and advancing movements from a supply roll 18 mounted at one end of thermoforming packaging machine 10. A product (not shown) is placed in the web of thermoformed product receptacles 14 by hand or by using a suitable dispenser (not shown).

The thermoforming packaging machine 10 includes a sealing station 20 that heat seals or otherwise secures a top film 22 to the bottom film 16 along the peripheral margin of the product-filled, product receptacles 14 to form a number of product packages 24 that are joined together as a web. The heat seal may be but is not necessarily a hermetic seal. The top film 22 is dispensed from a supply roll 26 of film in the same step-wise indexing fashion of stopped and advancing movements as the bottom film 16. The supply roll 26 is mounted at an overhead portion 28 of the thermoforming packaging machine 10 and the top film 22 is routed so that it feeds vertically downward to an upstream end of the sealing station 20 where it is then joined with the horizontally-advancing bottom film 16. Labeling (not shown) may be applied to the top film 22 prior to or after being joined with the bottom film 16. The top film 22 may also be a printed film that displays various indicia, such as a company logo, package contents, and/or package ingredients.

The thermoforming packaging machine 10 includes a hole cutting station 30 followed by a package separation station 32 where the formed, filled and sealed product packages 24 are separated from each other, such as by using crosscut knives or rotary knives (not shown). Safety guarding and panels that are normally present in the thermoforming packaging machine have been removed in FIG. 1 to aid in illustrating the hole cutting station 30 and the package separation station 32. The hole cutting station 30 includes one or more hole cutters 34 for cutting holes 36 (FIG. 10) and corresponding chads 38 (FIG. 10) in a marginal film area of a web of the formed, filled and sealed product packages 24. In the illustrated embodiment, three hole cutters 34 are used to simultaneously cut holes 36 in three rows of product packages 24.

Turning now to FIGS. 2-5, each hole cutter 34 comprises a rigid punch holder 40 that is mounted in a frame 42 for reciprocating movement between extended and retracted positions. Each of a plurality of film-cutting punches 44 is mounted in a hole 46 (FIG. 5) in the punch holder 40 and may be arrayed in spaced relationship to each other in a single row. Each film-cutting punch 44 has an elongated body 48 that is positioned within the hole 46 and includes a cutting end 50 that projects from the punch holder 40 above an upper surface thereof. In one embodiment, the cutting end 50 is a tapered, hollow cylinder and a small portion of the cutting end 50 is recessed within the punch holder 40 below the upper surface thereof (FIGS. 8-10) so that when the hole 36 is cut in the marginal film area by the film-cutting punch 44 during reciprocating movement of the punch holder 40 to the extended position, the chad 38 that is produced has an uncut portion along a circumference of the chad 38 that causes the chad 38 to remain attached to the marginal film area of the product package 24. In another embodiment, the cutting end 50 of each film-cutting punch 44 is not recessed below the upper surface of the punch holder 40 and the uncut portion of the chad 38 is created by only partially extending the cutting end 50 of the film-cutting punch 44 through the marginal film area during creation of the hole 36. The elongated body 48 of the film-cutting punch 44 may include a registration surface 52 (FIG. 5) against which is turned a set screw 54 for fixing a rotational position of the elongated body 48 of the film-cutting punch 44 within the hole 46 in the punch holder 40. The set screw 54 may also fix the longitudinal position of the film-cutting punch 44 within the hole 46.

Each hole cutter 34 further includes a platen 56 that is mounted in the frame 42 above and in opposition to the punch holder 40 and has at least one recess 58 positioned in alignment with the film-cutting punches 44 for receiving at least a portion of the cutting ends 50 of the film-cutting punches 44 when the punch holder 40 is in the extended position. The platen 56 serves to support the sealed bottom and top films 16 and 22 to resist stretching thereof as the cutting ends 50 of the film-cutting punches 44 press against and then through the bottom and top films 16 and 22 during the cutting of holes 36. In the illustrated embodiment, a separate one of the recesses 58 is provided for each of the film-cutting punches 44. To facilitate changing of the positioning of recesses 58, such as when a different pattern of film-cutting punches 44 is used in response to a change in the number and/or sizes of the formed, filled and sealed product packages 24 carried in the web, the recesses 58 may be formed in one or more inserts 60 that are slidably received within a keyed channel 62 within a lower portion of the platen 56. In the illustrated embodiment, a pair of the inserts 60 is used and the number of recesses 58 is evenly distributed between the two inserts 60. For example, when seven recesses 58 are present as illustrated, each insert 60 has three and one-half recesses 58 and the two half recesses 58 are positioned at the abutting ends of the inserts 60 to form a complete recess 58. Screws 64 or other fasteners may be used to hold the inserts 60 in fixed positions and may be removed to allow the inserts 60 to be slidably removed from opposite ends of the keyed channel 62.

The frame 42 on which the punch holder 40 and platen 56 are mounted comprises a bottom plate 66, a pair of guide shafts 68 that extend upwardly from the bottom plate 66 and terminate at their upper ends with threaded rods 70 (FIG. 5) on which the platen 56 is removably mounted and secured, such as by quick release toggle nuts 72, and a moveable base 74 on which the punch holder 40 is removably mounted. The moveable base 74 is carried along the guide shafts 68 during extension and retraction of an actuator 76 using flange bearings 78 mounted to an upper surface of the moveable base 74 in alignment with holes (not shown) through which the guide shafts 68 extend.

In the illustrated embodiment, the actuator 76 is a double-acting, pneumatic cylinder that is mounted underneath the bottom plate 66 and has a piston rod 80 that extends vertically through the bottom plate 66 and is connected to a lower surface of the moveable base 74 so that extension and retraction of the piston rod 80 causes upward and downward movement, respectively, of the moveable base 74. A set collar 81 (FIGS. 2, 3, 5-7) may be adjustably positioned on the piston rod 80 to limit the stroke length of the actuator 76 and thereby reduce the cycle time of the thermoforming packaging machine 10. In another embodiment, the actuator 76 may be a servo motor controlled linear actuator. A mounting clamp 82 is fixed to each of the guide shafts 68 above the path of travel of the moveable base 74 and is used for mounting the hole cutter 34 to one of a pair of spaced-apart rails 84 that extend horizontally within the hole cutting station 30 of the thermoforming packaging machine 10.

The moveable base 74 includes a lift plate 86 on top of which are mounted the flange bearings 78 and a support plate 88 for the punch holder 40. The support plate 88 extends in a vertical plane and is constructed in a manner to allow the punch holder 40 to be releasably connected to the support plate 88. In the illustrated embodiment, the support plate 88 has a number of locating pins 90 (FIG. 5) that extend upwardly from an upper surface of the support plate 88 and are received within complemental holes (not shown) extending into the punch holder 40 from its lower surface. The support plate 88 includes a pair of projections 92 that extend upwardly from opposite ends of the support plate 88 and are received within complemental cutouts 94 in opposite sides of the plate-like punch holder 40 that is generally coplanar with the support plate 88. Fasteners 96 extend transversely through the projections 92 and into holes 98 (FIG. 5) in the opposite sides of the punch holder 40 where the cutouts 94 are located to releasably secure the punch holder 40 to the support plate 88 of the moveable base 74. After the fasteners 96 are loosened, the punch holder 40 may be lifted upwardly and separated from the support plate 88 for replacement by another punch holder 40 carrying an array of the film-cutting punches 44 required for a different arrangement of formed, filled and sealed product packages 24 being processed by the thermoforming packaging machine 10. The inserts 60 that carry the recesses 58 in the platen 56 may likewise be replaced to match the new arrangement of film-cutting punches 44 in the punch holder 40.

In use, each hole cutter 34 may be used in a method to cut holes 36 and corresponding chads 38 in a marginal film area of the web of formed, filled and sealed product packages 24 in the thermoforming packaging machine 10. The method includes the steps of forming and filling the product packages 24 at the package forming stations 12 as the bottom film 16 is advanced in a step-wise indexing fashion from a supply roll 18. The formed and filled product receptacles 14 are advanced to the sealing station 20 where the top film 22 advanced from a supply roll 26 in the same step-wise indexing fashion and is sealed to the bottom film 16 in the marginal film area surrounding the product receptacles 14. The web of sealed product packages 24 are then advanced to the hole cutting station 30 and routed horizontally between the platen 56 and the rigid punch holder 40. Each hole cutter 34 is adjusted so that the platen 56 is spaced slightly above the planar top film 22 in the web of sealed product packages 24 and the film-cutting punches 44 in the punch holder 40 are positioned below the bottom film 16 in the product receptacles 14 when the punch holder 40 is in the retracted position. The web of product packages 24 may be supported on a number of parallel, horizontally-extending support rails 100 (FIGS. 4, 6 and 7) are provided in the thermoforming packaging machine 10 and slots 102 are provided in the punch holder 40 in alignment with the support rails 100 to allow the punch holder 40 to be moved to the extended position without interference from the support rails 100. The web of product packages 24 is forwardly advanced while the punch holder 40 is in the retracted position.

Figure 8:
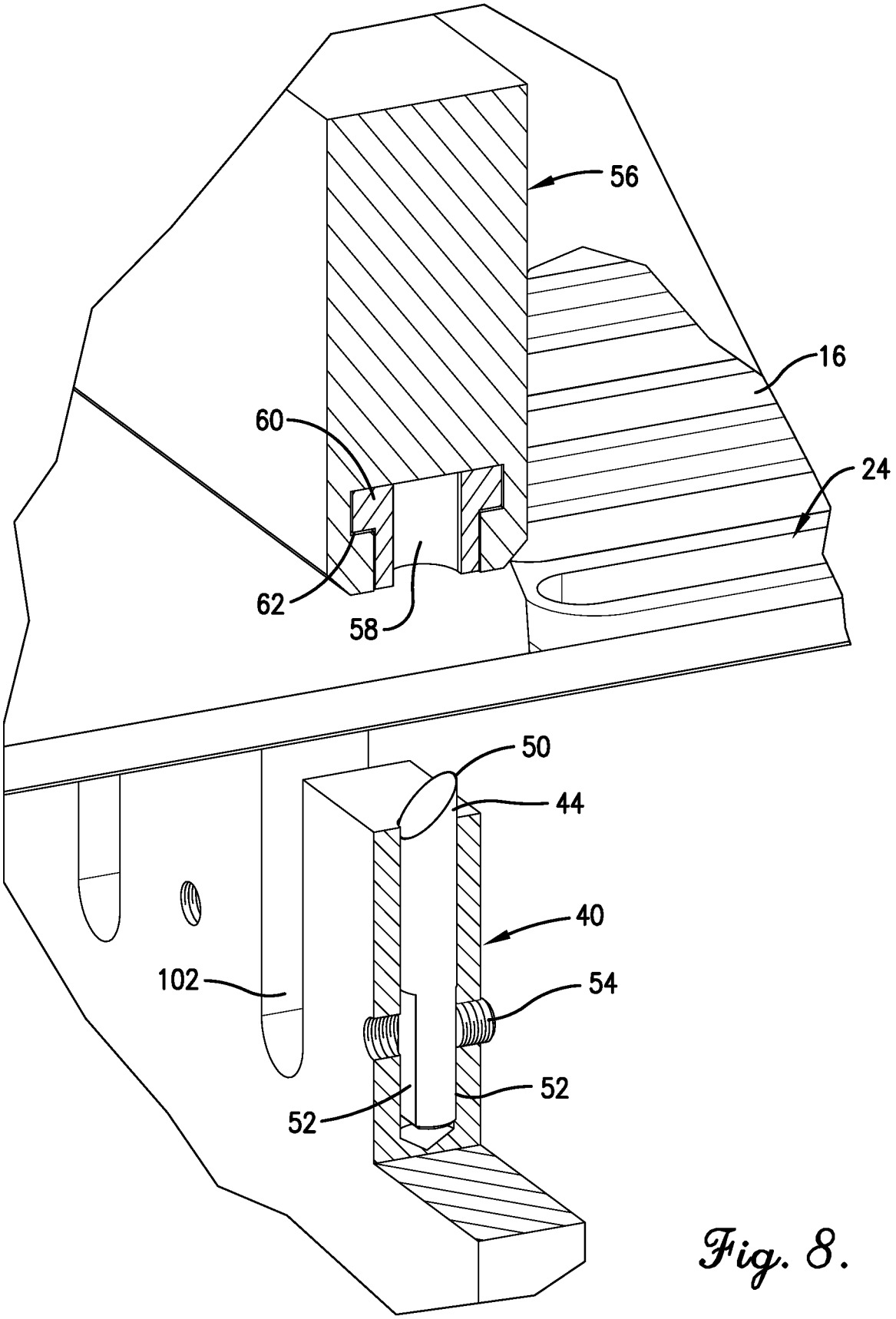
FIG. 8 is an enlarged, fragmentary side perspective view of the hole cutter and the web of product packages, with the hole cutter shown in the retracted position ready for being moved to an extended position to punch holes and create corresponding chads in the web of product packages.
Figure 9:
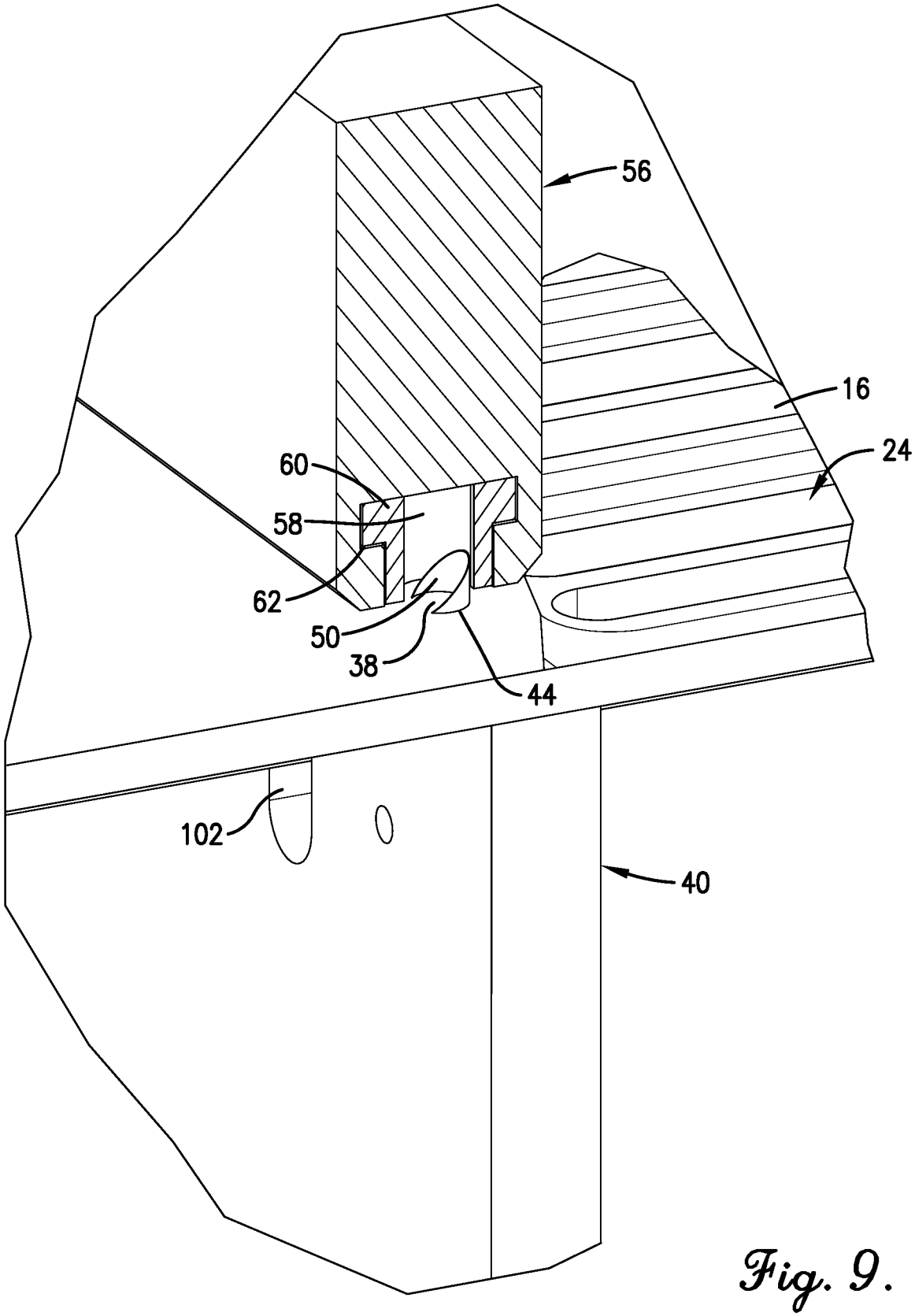
FIG. 9 is an enlarged, fragmentary side perspective view of the hole cutter and the web of packages similar to the view shown in FIG. 8, but with the hole cutter shown in the extended position and showing one of the cutters punching a hole in the web of product packages.
Figure 10:
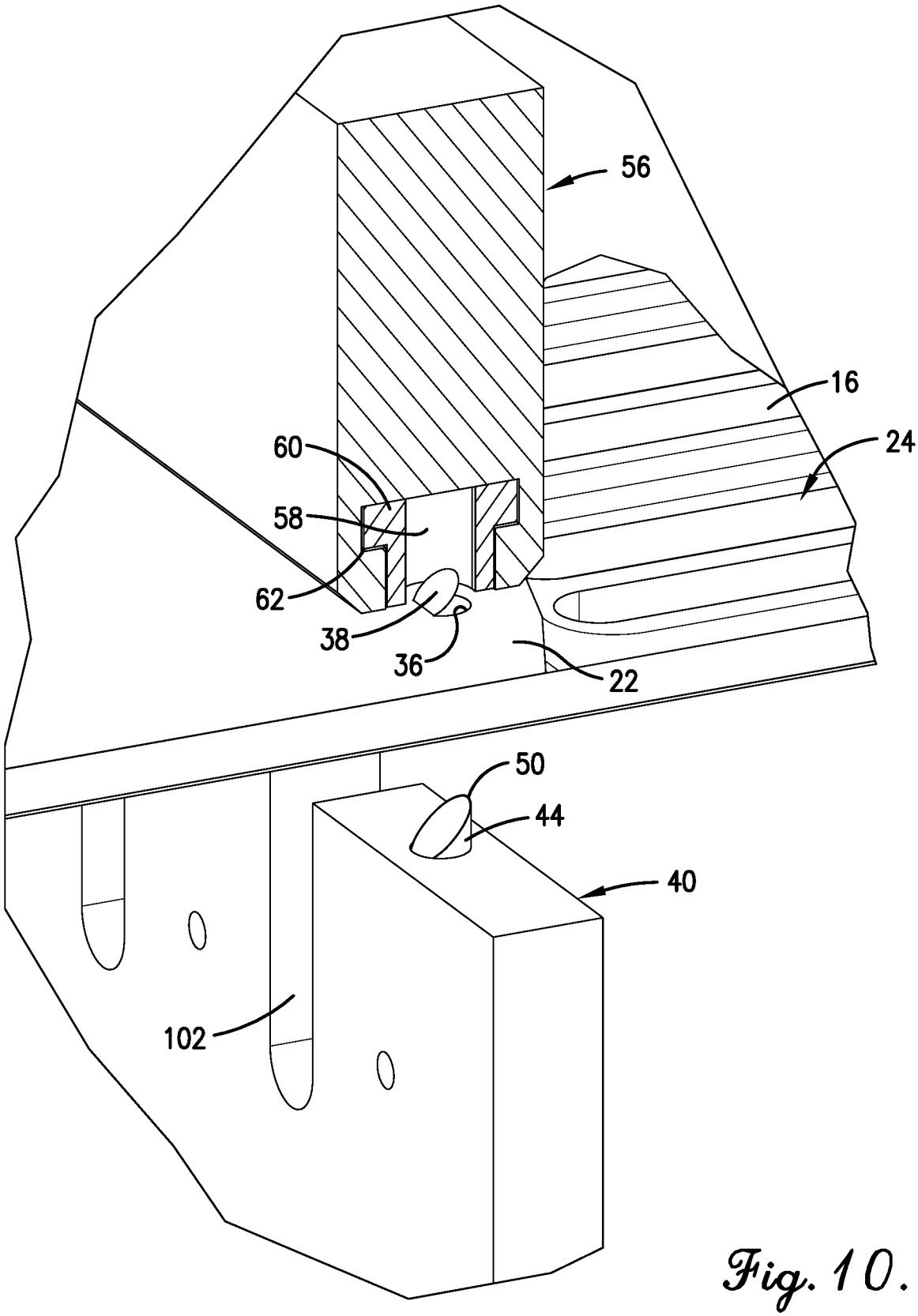
FIG. 10 is an enlarged, fragmentary side perspective view of the hole cutter and the web of packages similar to the views shown in FIGS. 8 and 9, but with the hole cutter shown in the retracted position and showing one of the punched holes and the corresponding chad in the web of packages.

When the top marginal film area of a row of the product packages 24 is in vertical alignment with the film-cutting punches 44, the forward movement of the web of product packages 24 is stopped and the actuator 76 is reciprocally operated to move the rigid punch holder 40 to the extended position. The tapered cutting end 50 of each film-cutting punch 44 is extended through the top marginal film area of one of the product packages 24 when the rigid punch holder is moved to the extended position to cause each film-cutting punch 44 to cut in the marginal film area to create one of the holes 36 and the corresponding chad 38. Because a portion of the cutting end 50 of each film-cutting punch 44 is recessed below the upper surface of the punch holder 40, the chad 38 has an uncut portion along a circumference of the chad 38 that causes the chad 38 to remain attached to the marginal film area when the rigid punch holder 40 is reciprocated by the actuator 76 to the retracted position. Alternatively, all of the cutting end 50 of each film-cutting punch 44 may be positioned above the upper surface of the punch holder 40, in which case the uncut portion of the circumference of the chad 38 is created by limiting the extension of the cutting end 50 through the top marginal film area of the product package 24. As shown in FIG. 10, the uncut portion of the chad 38 may be positioned on the side of the hole 36 in a direction opposite from the product packages 24. In other embodiments, the uncut portion of the chad 38 may be located at other positions, such as 180 degrees from the position shown in FIG. 10, by rotating the position of the film-cutting punch 44. As can be seen in FIG. 8, a second one of the registration surfaces 52 may be provided on the elongated body 48 of the film-cutting punch 44 for this purpose.

When a single one of the hole cutters 34 is used, the web is advanced and then stopped when the top marginal film area of the next row of the product packages 24 is in vertical alignment with the film-cutting punches 44. If multiple ones of the hole cutters 34 are used, they normally are activated to punch holes 36 at the same time and the web is advanced accordingly. The actuator 76 is then reciprocally operated to move the punch holder 40 to the extended position to cut the next set of holes 36 in the same manner described above.

Figure 4:
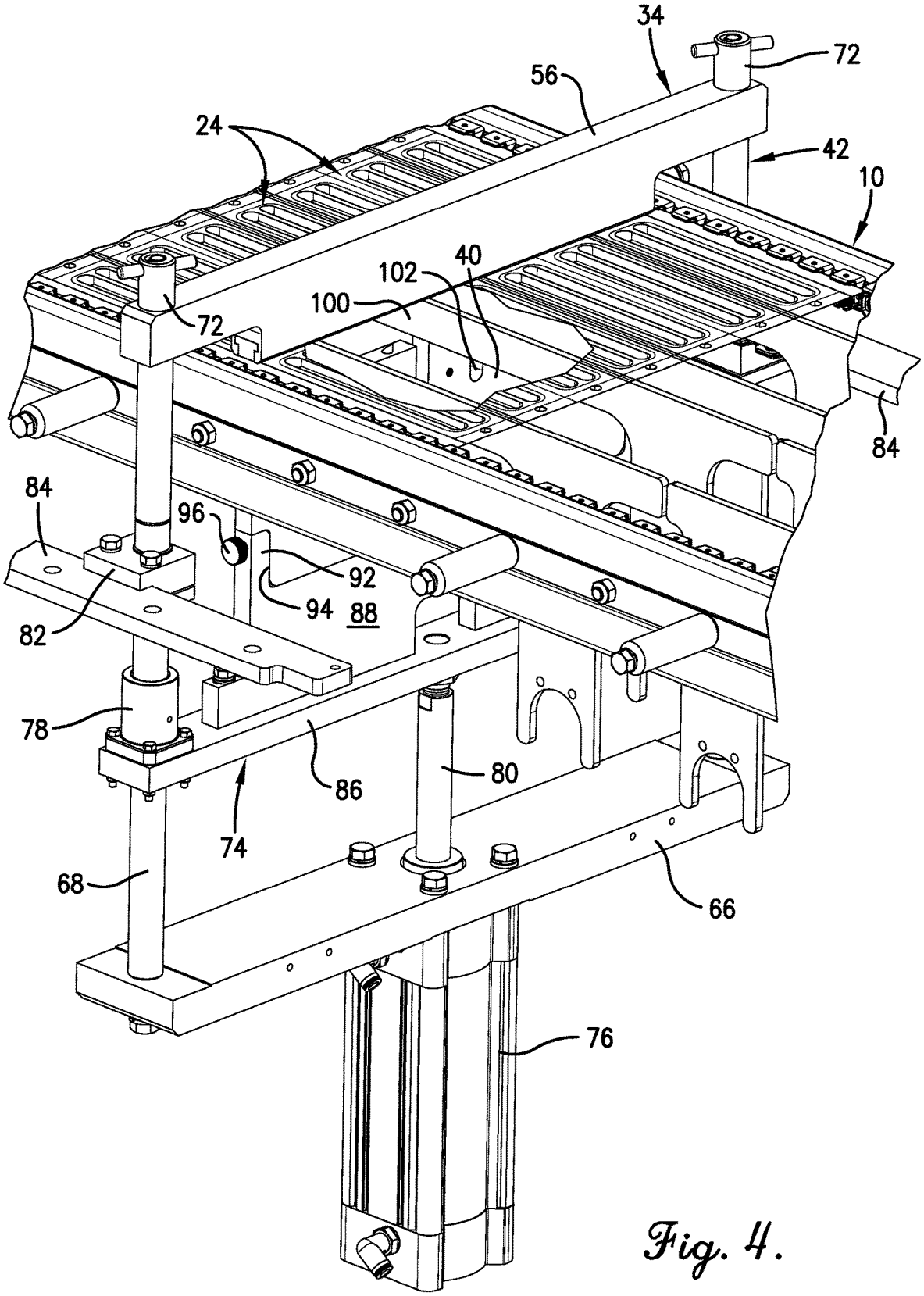
FIG. 4 is a front perspective view of the hole cutter and a fragmental portion of the horizontal form-fill-seal machine.
Figure 5:
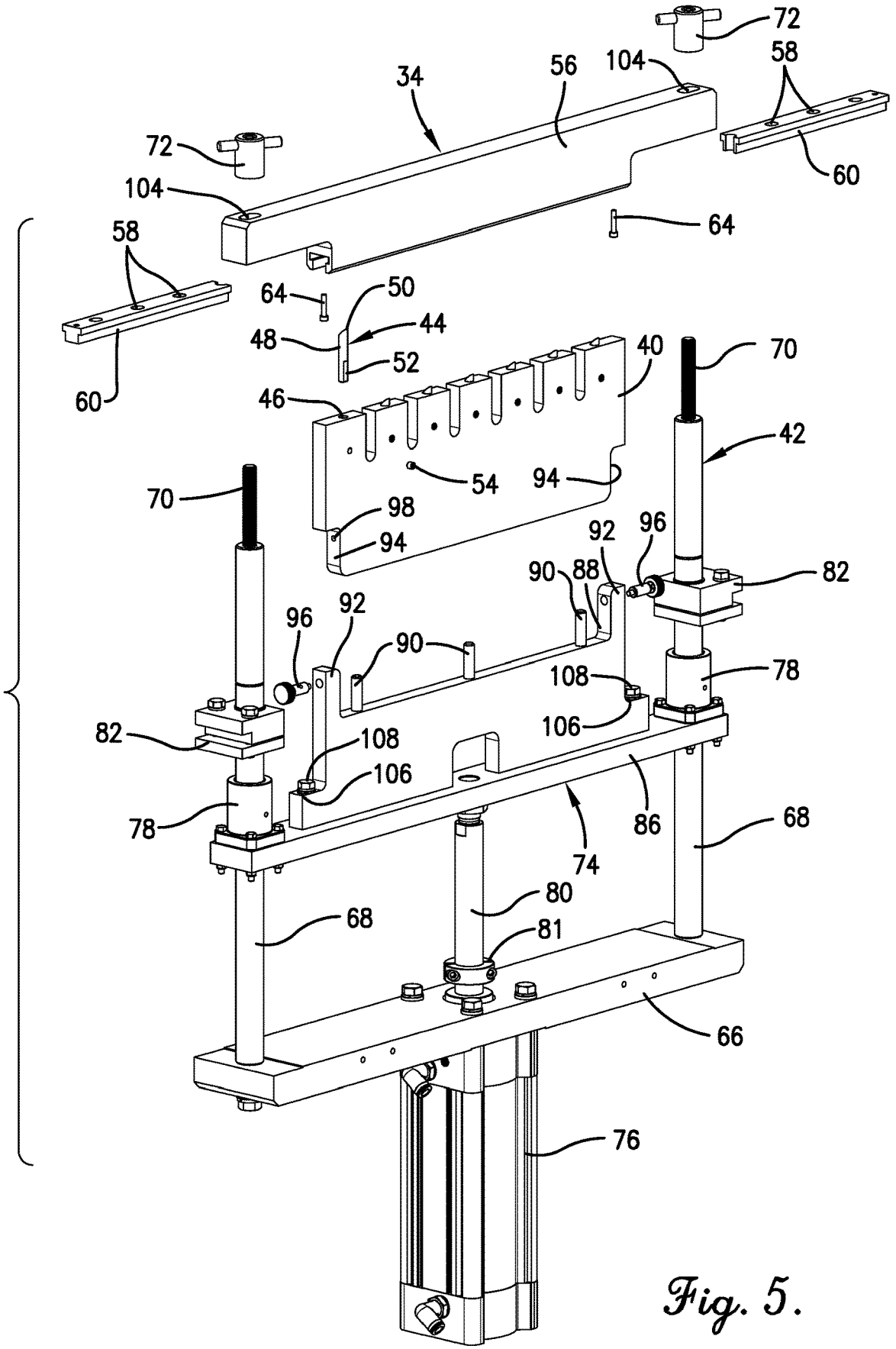
FIG. 5 is an exploded, front perspective view of the hole cutter.
Figure 6:
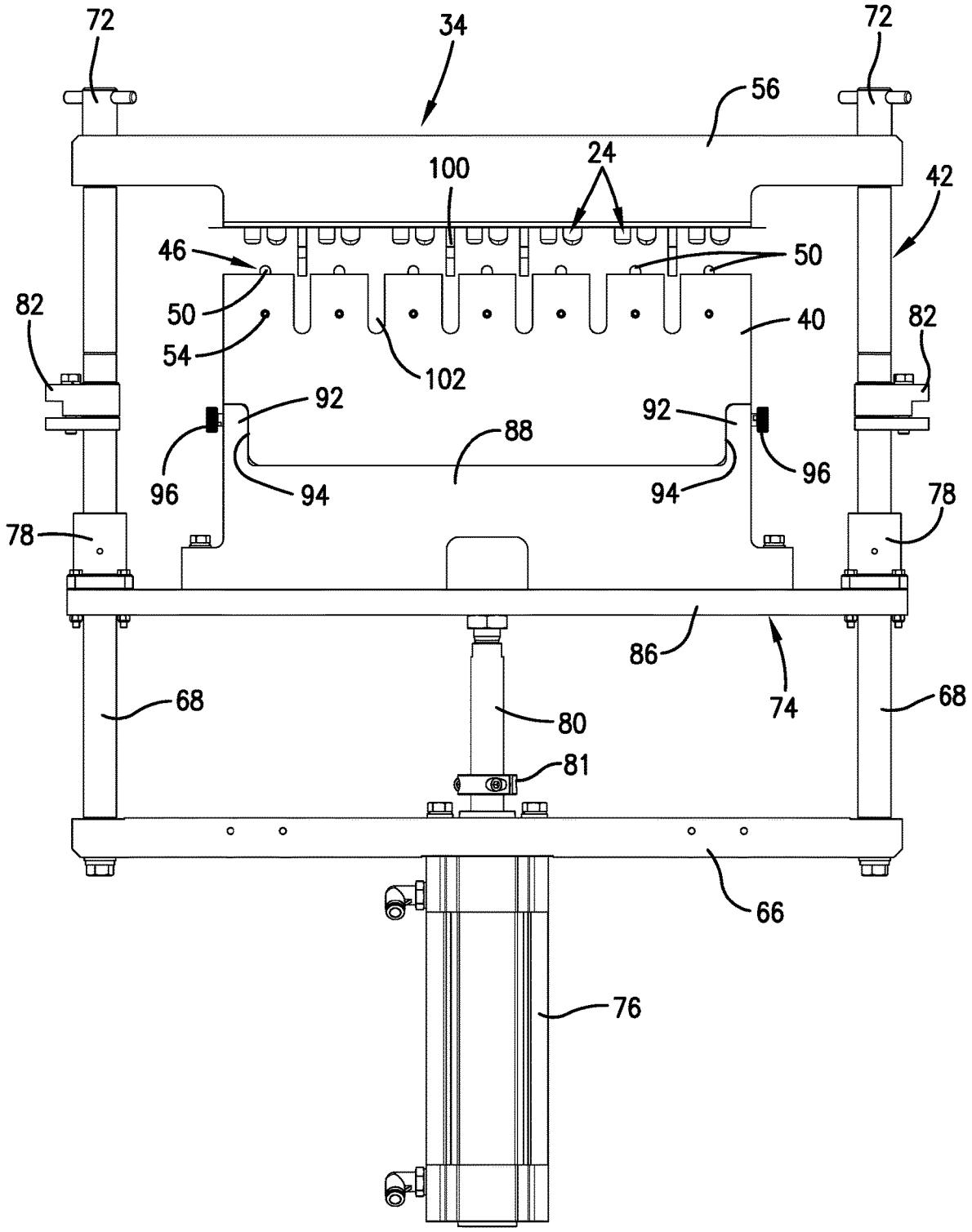
FIG. 6 is a front elevation view of the hole cutter and a web of formed, filled and sealed product packages, with the hole cutter shown in a retracted position to allow advancement of the web of packages.
Figure 7:
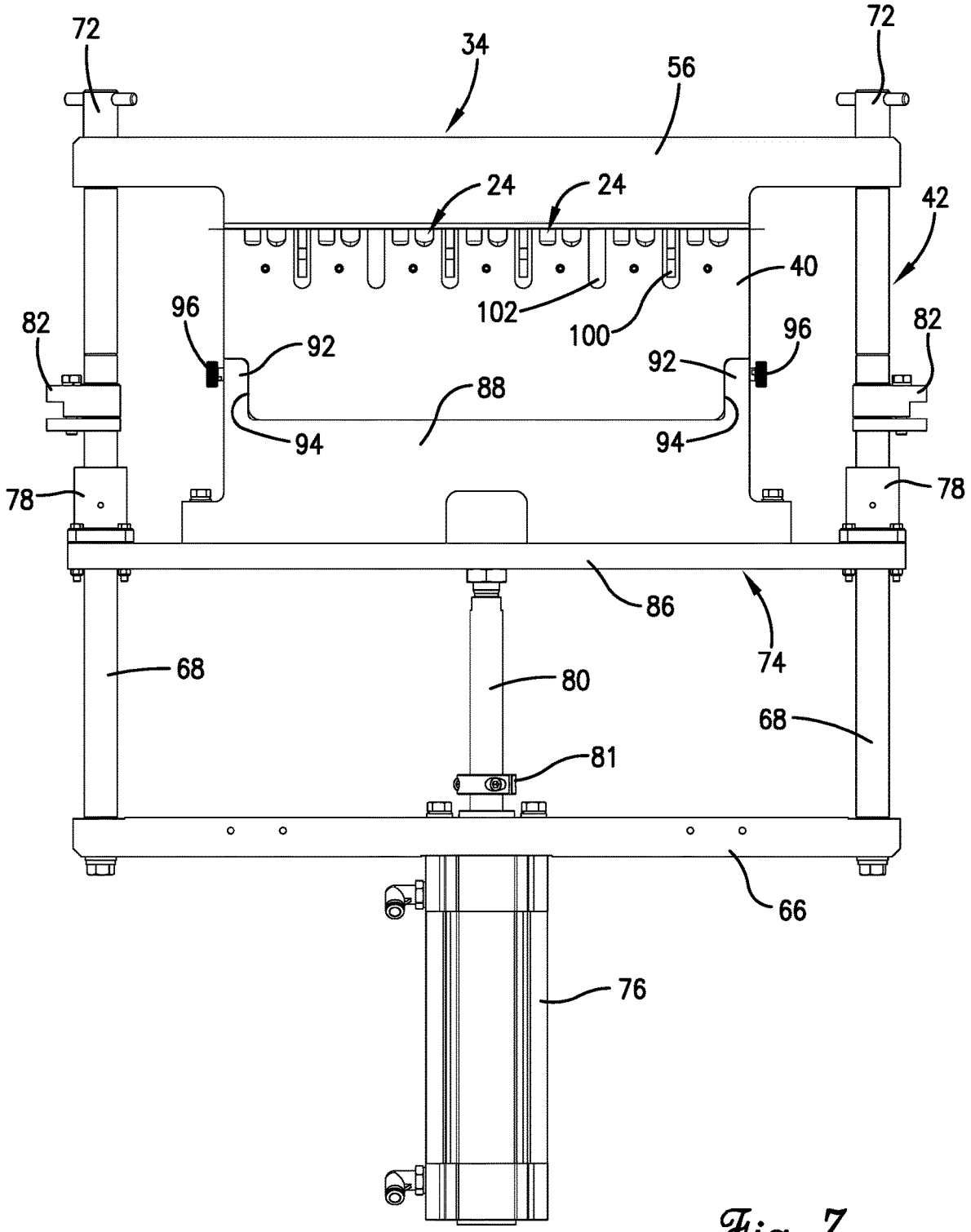
FIG. 7 is a front elevation view of the hole cutter and the web of product packages similar to the view shown in FIG. 6, but with the hole cutter shown in an extended position to punch holes and corresponding chads in the web of product packages.

To facilitate the placement of the holes 36 at the desired location in the marginal film area of the product packages 24, the hole cutters 34 may be adjusted along the rails 84 and secured by the mounting clamps 82 at the desired location in the longitudinal direction of the web, as can be seen in FIG. 4. The punch holder 40 and the platen 56 may also be adjusted in a direction across the web during the setup of the hole cutters 34. In one embodiment, as shown in FIG. 5, this adjustment across the web is permitted by providing slots 104 in the platen 56 through which the threaded rods 70 extend and by providing similar slots 106 in the support plate 88 through which fasteners 108 extend to secure the support plate 88 and the punch holder 40 to the lift plate 86. The slots 104 and 106 are oriented with their major dimension oriented across the web to allow for the sideways adjustment of the position of the platen 56 and the punch holder 40 that carries the film-cutting punches 44 that create the holes 36.

Because the film-cutting punches 44 extend upwardly from the punch holder 40, any loosening of the film-cutting punches 44 would cause them to move downwardly and create a larger uncut portion of the circumference of the chad 38, rather than completely severing the chad as can occur with conventional hole punching devices in which the punch is threaded on the end of the downwardly extending piston rod. In addition, the set screw 54 that is engaged against the registration surface 52 on the elongated body 48 of the film-cutting punch 44 resists against rotation of the film-cutting punch 44 as can occur with threaded punches and ensures that the uncut portion of the circumference of the chad 38 remains aligned at the top of the product package 24. Notably, because a single actuator 76 is used to move the all of the film-cutting punches 44 required for a row of product packages 24, maintenance and energy savings can be realized in comparison to conventional hole punching devices that use a separate pneumatic cylinder for each punch.

It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the drawing figures is to be interpreted as illustrative and not in a limiting sense.

What is claimed is:

1. A horizontal form, fill and seal machine comprising:

a package forming station configured to form a plurality of product receptacles in a bottom film and receive product therein;

a sealing station downstream of the package forming station and configured to secure a top film to the bottom film along a peripheral margin of the product receptacles thereby forming a web of formed, filled and sealed product packages; and a hole cutting station downstream of the package forming station for cutting holes in a marginal film area of the web of formed, filled and sealed product packages, the hole cutting station including a hole cutter having:

a rigid punch holder mounted in a frame for reciprocating movement between extended and retracted positions;

a plurality of film-cutting punches mounted in and extending upwardly from the punch holder and having a cutting end projecting from the punch holder;

a platen mounted above and in opposition to the punch holder and having at least one recess positioned in alignment with the film-cutting punches for receiving at least a portion of the cutting ends of the film-cutting punches when the rigid punch holder is elevated to the extended position; and an actuator coupled with the punch holder and operable to cause the reciprocating movement of the punch holder between the extended and retracted positions, wherein the web of formed, filled and sealed product packages extends horizontally between the rigid punch holder and the platen.

2. The horizontal form, fill and seal machine of claim 1, wherein the actuator is a pneumatic cylinder and wherein the at least one recess comprises a separate one of the recesses for each one of the film-cutting punches.

3. The horizontal form, fill and seal machine of claim 1, wherein the cutting end of each of the film-cutting punches is tapered.

4. The horizontal form, fill and seal machine of claim 3, wherein a portion of the tapered cutting end of each film-cutting punch is recessed within the punch holder so that when a hole is cut in the marginal film area by the film-cutting punch during reciprocating movement of the rigid punch holder to the extended position a chad is produced that has an uncut portion along a circumference of the chad that causes the chad to remain attached to the marginal film area.

5. The horizontal form, fill and seal machine of claim 4, wherein each of the film-cutting punches has an elongated body and a registration surface for fixing a rotational position of the elongated body within the punch holder.

6. The horizontal form, fill and seal machine of claim 1, wherein the frame comprises a pair of guide shafts, a moveable base that is carried along the guide shafts during extension and retraction of the actuator, and a bottom plate on which the actuator is mounted and from which the guide shafts extend upwardly and wherein the punch holder is removably mounted to the moveable base and the platen is positioned above the punch holder and is removably mounted to an upper end of the guide shafts.

7. The horizontal form, fill and seal machine of claim 1, wherein the platen includes an insert that is removably associated with the platen and contains the receiving openings.

8. The horizontal form, fill and seal machine of claim 7, including clamps coupled with the guide shafts for mounting the hole cutter to rails in the horizontal form, fill and seal machine.

9. A method for cutting holes in a marginal film area of a web of formed, filled and sealed product packages in a horizontal form, fill and seal machine comprising the steps of:

advancing a web of formed, filled and sealed product packages in a horizontal direction between a rigid punch holder and a platen of a hole cutter of the horizontal form, fill and seal machine in a cycle of stopped and advancing movement, the hole cutter comprising:

the rigid punch holder mounted in a frame for reciprocating movement between extended and retracted positions;

a plurality of film-cutting punches mounted in and extending upwardly from the punch holder and having a cutting end projecting from the punch holder;

the platen mounted above and in opposition to the punch holder and having at least one recess positioned in alignment with the film-cutting punches for receiving at least a portion of the cutting ends of the film-cutting punches when the rigid punch holder is elevated to the extended position; and an actuator coupled with the punch holder and operable to cause the reciprocating movement of the punch holder between the extended and retracted positions;

operating the actuator to reciprocate the rigid punch holder to the extended position when the web is stopped and to the retracted position when the web is advancing; and extending a portion of a tapered cutting end of each film-cutting punch through the marginal film area when the rigid punch holder is moved to the extended position to cause each film-cutting punch to cut in the marginal film area to create a hole and a corresponding chad, wherein the chad has an uncut portion along a circumference of the chad that causes the chad to remain attached to the marginal film area when the rigid punch holder is reciprocated to the retracted position.

* * * * *